US006321905B1

(12) United States Patent
Sykes

(10) Patent No.: US 6,321,905 B1
(45) Date of Patent: Nov. 27, 2001

(54) SECURITY PACKAGE

(75) Inventor: Philip K. Sykes, Shoreview, MN (US)

(73) Assignee: Emplast, Inc., Chanhassen, MN (US)

( * ) Notice: Subject to any disclaimer, the term of this patent is extended or adjusted under 35 U.S.C. 154(b) by 0 days.

(21) Appl. No.: 09/649,534

(22) Filed: Aug. 28, 2000

(51) Int. Cl.[7] ..... B65D 85/57; B65D 85/575
(52) U.S. Cl. ..... 206/1.5; 206/308.2; 206/387.11
(58) Field of Search ..... 70/63; 206/1.5, 206/77.1, 308.1, 308.2, 387.11, 807

(56) References Cited

U.S. PATENT DOCUMENTS

| | | | | |
|---|---|---|---|---|
| D. 343,356 | | 1/1994 | Wittman | D9/415 |
| 3,159,274 | * | 12/1964 | Burt | 206/77.1 |
| 3,495,716 | * | 2/1970 | Gregory | 206/387.11 |
| 4,381,836 | * | 5/1983 | Rivkin et al. | 206/387.11 |
| 4,805,769 | * | 2/1989 | Soltis et al. | 206/308.2 |
| 4,834,238 | * | 5/1989 | Hehn et al. | 206/387.11 |
| 4,865,190 | * | 9/1989 | Gregerson et al. | 206/1.5 |
| 4,871,065 | * | 10/1989 | Hehn et al. | 206/807 |
| 5,211,283 | * | 5/1993 | Weisburn et al. | 206/1.5 |
| 5,601,188 | | 2/1997 | Dressen et al. | 206/308.2 |
| 5,931,291 | * | 8/1999 | Sedon et al. | 206/1.5 |
| 5,944,173 | | 8/1999 | Boire et al. | 206/1.5 |
| 6,102,200 | * | 8/2000 | Dressen et al. | 206/308.2 |
| 6,135,280 | * | 10/2000 | Burdett et al. | 206/387.11 |

* cited by examiner

*Primary Examiner*—Jim Foster
(74) *Attorney, Agent, or Firm*—Nikolai & Mersereau, P.A.

(57) ABSTRACT

A security device for use in retail establishments to lock onto articles which are for sale and which optionally has enclosed an electronic article surveillance tag to prevent shoplifting. The security device has four hinged walls with flanges for wrapping around and securing an item therein. The front wall has a locking mechanism and a strap. A male member on the locking mechanism fits through apertures in the strap and into a female locking mechanism portion. The locking mechanism cannot be opened without a key. The locking mechanism comprises a pair of asymmetric tines which are on opposite sides of an asymmetric engagement member. To lock the security device the asymmetric engagement member spreads apart the asymmetric tines until the asymmetric engagement member gets passed the asymmetric tines. The asymmetric tines close behind the asymmetric engagement member and lock the asymmetric engagement member in place. The asymmetric tines must be separated by an asymmetric key to allow the asymmetric engagement member to pass by the asymmetric tines to unlock the security device. The asymmetric tines and the asymmetric engagement member are shaped to prevent tampering with the locking mechanism and making the security device harder to open without a complimentary asymmetrically shaped key.

5 Claims, 4 Drawing Sheets

SECURITY PACKAGE

BACKGROUND OF THE INVENTION

I. Field of the Invention

The present invention relates generally to security devices for items such as DVD's CDs, Audio Cassettes, Video Cassettes, and other articles having rectangular shapes, which can be surrounded by and secured by the security package. The perimeter walls surround the item and have a top and bottom flange for securing an item. The front wall has a locking mechanism and an overlapping front wall strap to lock the security package. More particularly, the present invention relates to a security device having an asymmetric locking mechanism, as well as an internally disposed electronic article surveillance (EAS) tag therewithin and a asymmetric key for unlocking the locking mechanism.

II. Discussion of the Prior Art

In an effort to thwart or eliminate the theft of items offered for sale in stores, retailers have for years worked toward tagging such articles with devices having improved security characteristics. Some devices are rather large and have cumbersome attachment means for securing the device to the item. Some devices are not easily removed from the item at the checkout counter.

To further reduce the likelihood of thievery, some security devices include electronic article surveillance (EAS) tags disposed within the security device so that an alarm will sound within the retail store if a thief attempts to leave the premises without having the store clerk remove or disable the EAS tag.

The security devices must be either easily removed from the items sold at the checkout counter prior to the customer leaving the store such that the EAS does not sound and the security package can be reused at the store or the EAS must be disarmed at the checkout counter and he security package opened by the customer at home.

Some thieves have found means to open or remove the devices such that items can be stolen easier. A security device with an EAS and a secure lock which can be easily opened with the proper key but hard to open by other means, is needed by the retail industry.

The security devices used should allow the item for sale to be displayed such that it is easily viewable by the customer yet secured inside a security package to prevent theft. The security package should be easily secured to the item.

SUMMARY OF THE INVENTION

The present invention, provides a security device having four walls having hinges which can be placed around the perimeter of an item to hold it and secured by an asymmetric locking mechanism integral with the device which is difficult to open without an asymmetric key and which resists opening by other means. The fours walls are hinged for ease of placing them around the item to be secured. The front wall has a locking mechanism and a front strap with apertures therethrough for lockingly securing the front strap to the locking mechanism.

The locking mechanism has a door portion and a security device locking mechanism portion attached by a hinge at one side for ease of alignment of the engagement member pod on the door portion with the tine member pod in the locking mechanism portion and for ease of locking and unlocking the security package. The tine member pod has at least two opposing tines, one on each side of the engaging member. The engagement member is shaped such that the tines will slip over the engaging member when closing the locking mechanism. When the security device locking mechanism is closed the tines will be positioned under the engagement member locking the security device locking mechanism. A key is necessary to move the tines from under the engagement member to open the security device locking mechanism. The engagement members, tines and keys all have asymmetric shapes to deter unauthorized opening of the security devices. The asymmetric tines compliment the shape of the asymmetric engagement portion for ease of closing the security device locking mechanism, and for opening it with the asymmetric key.

The pods have walls, which restrict access to the tines to prevent opening of the security device with an implement other than a key.

The security device has an EAS secured inside of the security device body so that it can not be removed or tampered with.

The security devices can be easy removed at a checkout counter with the key and reused on other items placed on the shelves of the store for sale.

OBJECTS OF THE INVENTION

It is accordingly a principal object of the present invention to provide an improved security device for items placed on display for sale at stores.

It is a further object of the present invention to provide a relatively inexpensive lockable security device that can be used in conjunction with retailers' present electronic anti-theft alarm activators.

It is a further object of the present invention to provide a lockable security device compatible with having an EAS tag therein.

It is yet another object of the invention to provide an asymmetric locking mechanism in the security device.

It is an object of the invention to provide an asymmetric key for opening the asymmetric locking mechanism in the security device.

It is an object of the invention to provide a security device, which can easily encase items to be secured.

It is an object of the invention to secure an item by its perimeter allowing the item offered for purchase to be viewed.

Other objects, advantages and novel features of the present invention will become apparent from the following detailed description of the invention when considered in conjunction with the accompanying drawings.

DETAILED DESCRIPTION OF THE PREFERRED EMBODIMENT

Figure 1:
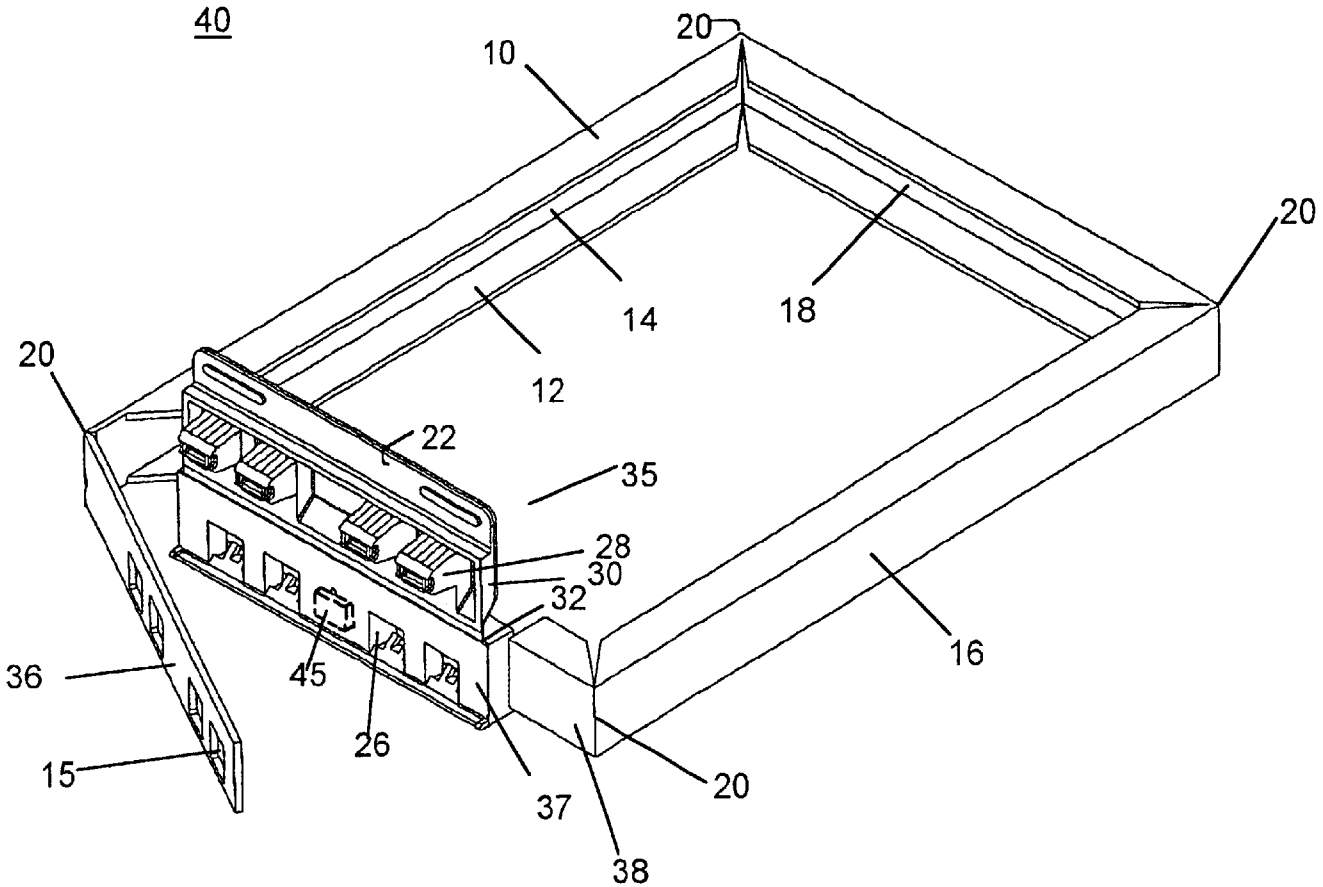
FIG. 1 is a perspective view of the security package with an asymmetric locking mechanism.

FIG. 1 shows a perspective view of the security package 40 having a front strap 36 and a locking mechanism panel 37. The front strap 36 is hinged 20 for placing the apertures 15 over the tine member pods 26 on the locking mechanism panel 37. The apertures 15 are sized and spaced to allow engagement member pods 28 to pass therethrough. When the apertures 15 are aligned with tine member pods 26 the door portion 30 on the locking mechanism 35 swings on hinge 32 allowing engagement member pods 28 to engage the tine member pods 26. The hinge 32 may be a thinned portion of the material of the locking mechanism 35 so that the door portion 30 is integral with the tab locking mechanism panel 37. The front strap 36 is then lockingly secured to the locking mechanism panel 37.

The security package 40 has four walls, a front wall 38 which includes the locking mechanism 35 and the front strap 36, a back wall 18 a left wall 14 and a right wall 16. The walls have a perimeter just slightly larger than an item to be secured therein. The walls, 38, 14, 16, 18 also have a top flange 10 and a bottom flange 12 spaced apart just large enough to encase the item secured by the security package 40. The walls 38, 14, 16, 18 and the front strap 36 all have hinges 20 allowing the security package 40 to be easily placed around the perimeter of the item to be secured therein. The hinges 20 can be thinned portions of the material the security package 40 is made out of, which is preferably a polyethylene or other plastic material. The flanges 10, 12 in the embodiment are shown meshed together when the security package 40 engages the item enclosed therein.

The locking mechanism panel 37 has an electronic article surveillance (EAS) tag 45 secured inside of the body thereof such that the EAS tag 45 cannot be removed from the security package 40. The EAS tag 45 sounds an alarm if the security package 40 and the item therein passes a detector located near a store exit. In this manner shoplifting is deterred.

Figure 2:
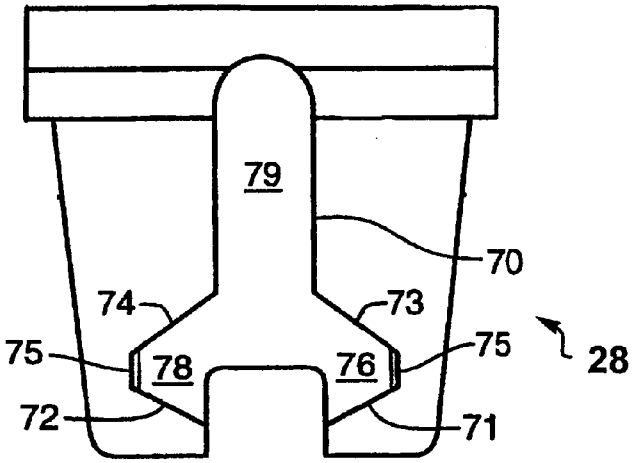
FIG. 2 is a side view of the engagement member.
Figure 3:
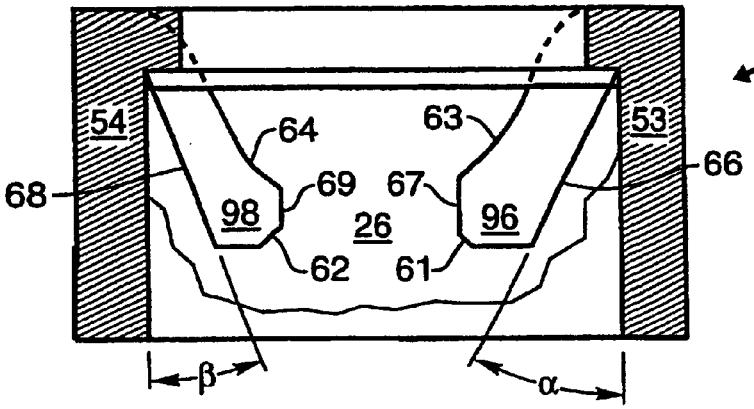
FIG. 3 is a side view of the angled tine members.
Figure 4:
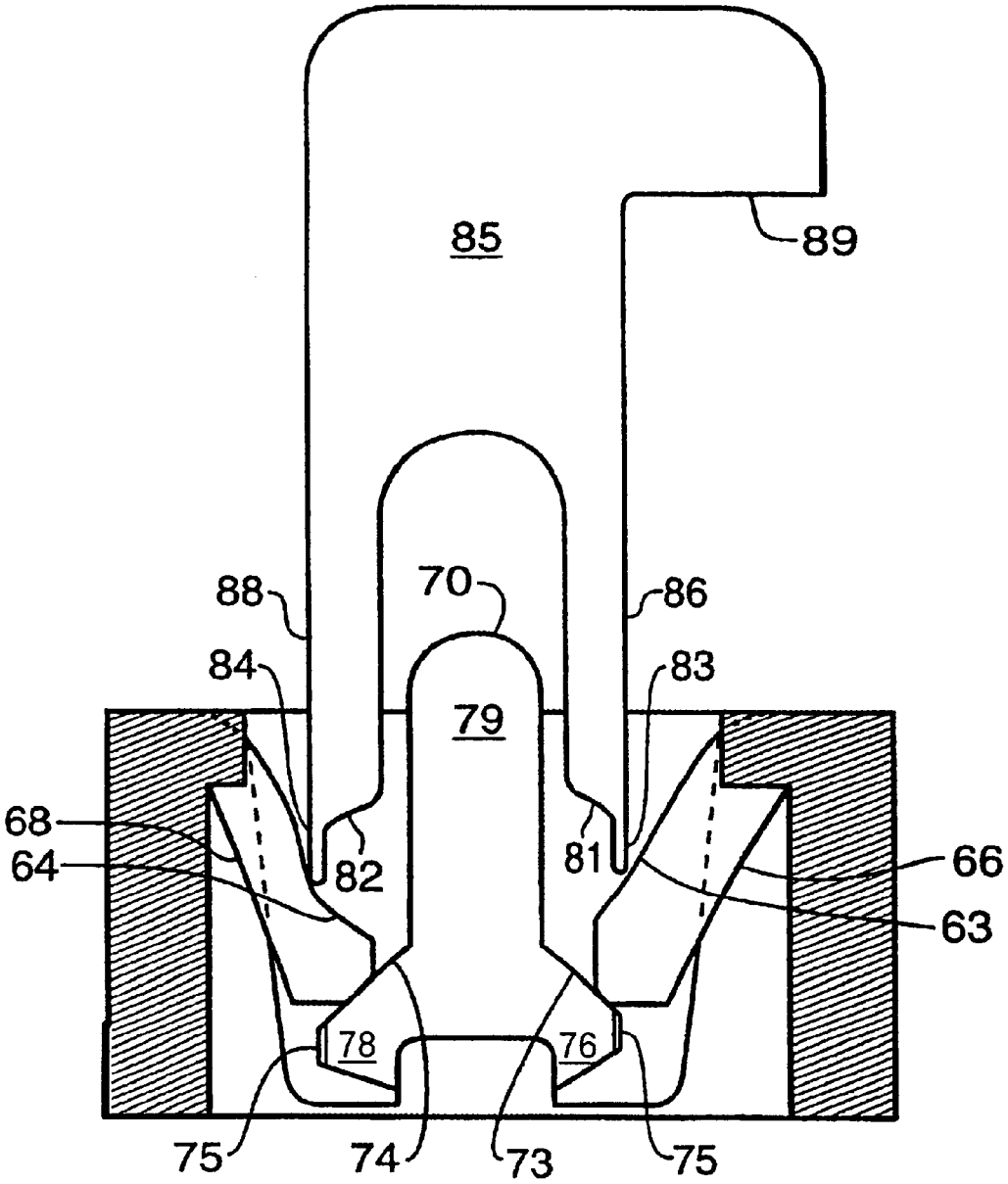
FIG. 4 is a side view of the angled tine member proximate the engagement member in the locked position with an asymmetric key for opening the asymmetric locking mechanism.
Figure 5:
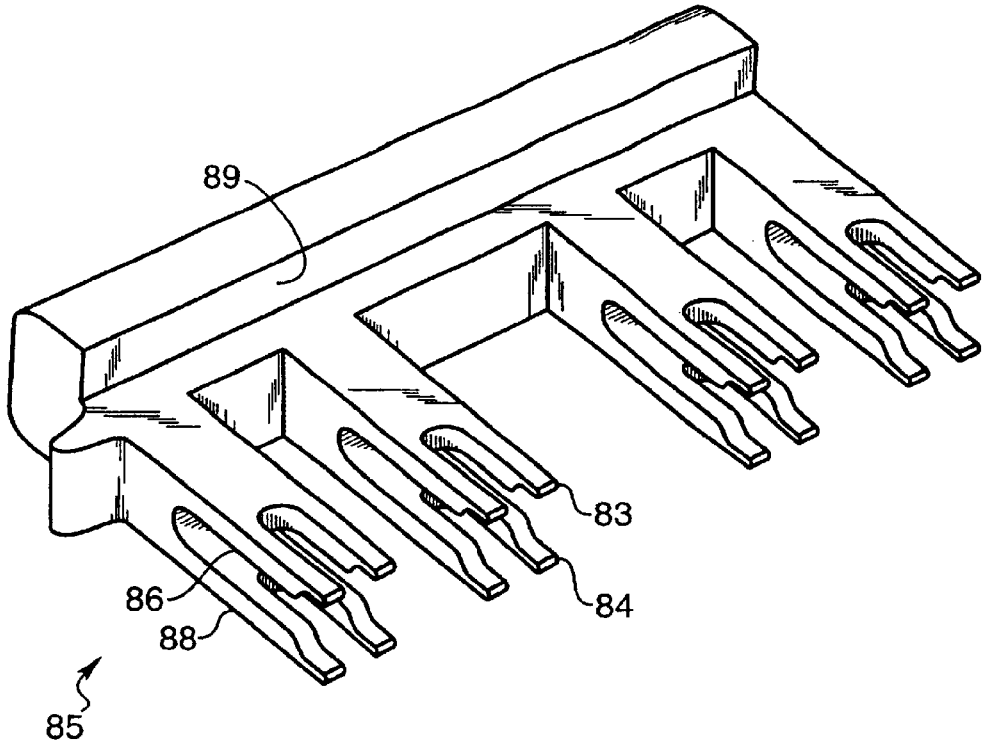
FIG. 5 is a perspective view of the asymmetric key.

Although the security package 40 will function with any locking mechanism such as a male portion fitting into and lockingly engaged with a female portion, a preferred locking mechanism for securing of the security device is an asymmetric tine mechanism as shown in FIGS. 2, 3 and 4, which can be opened with an asymmetric key as shown in FIGS. 4 and 5.

FIG. 2 shows a side view of a portion of an asymmetric engagement member 70 in engagement member pod 28. The asymmetric engagement member 70 has a right engagement member portion 76 and a left engagement portion 78 which have right and left angled bottom portions 71 and 72 respectively right and left angled top portions 73 and 74. The angled portions 71, 72, 73, 74 of the asymmetric engagement member 70 all have different angles. The asymmetric engagement member also has a trunk portion 79.

FIG. 3 shows a side view of a portion of a tine member pod 26 with a right tine member 66 and a left tine member 68. The tine members 66, 68 are deflected by a portion of the angles $\alpha$ and $\beta$ of the right tine member 66 and the left tine member 68 respectively relative to the right and left pod walls 53, 54 in order to move the tine members 66, 68 to lock and unlock when engaged by right engagement member portions 76 and a left engagement member portions 78 of asymmetric engagement member 70. It should be noted that the right tine member base portion 96 is thicker at the base than the rest of the right tine member 66. Similarly the left tine member base portion 98 is thicker at the than the rest of the tine member 68.

As can be understood from FIGS. 2 and 3 when viewed together the locking the locking mechanism works as follows. The asymmetric engagement member 70 will push apart the right and left tine members 66 and 68 by contact with the angled bottom portions 71, 72 and angled surfaces 63 and 64 of the tine members 66 68. When the asymmetric engagement member 70 has spread the tine members 66, 68 apart sufficiently the parallel portions 75 and 67, 69 slide past each other. After the right and left tine members 66, 68 pass the parallel portions 75 of the asymmetric engagement member 70, the engaging surfaces 61 and 62 of the right and left tine members 66 and 68 are adjacent the angled top portions 73, 74 of the right and left engagement members portions 76, 78. As seen in FIG. 4, the angles of the surfaces match for parallel engagement such that the asymmetric engagement member 70 cannot be withdrawn from the locking mechanism without spreading apart the right and left tine members 66, 68.

In order to unlock the locking mechanism an asymmetric key 85 is required as shown in FIG. 4. The key 85 must be inserted into the top of engagement pod member 28. The asymmetric key 85 has key long thin arms 86, 88 which just fit into spaces in the engagement pod member 28 and push aside the right and left tine members 66, 68 by contacting them on the angled surfaces 63, 64 with the tip portions 83, 84 of key arms 86, 88. The key 85 is shaped like the asymmetric engagement member 70 wherein the angles 81, 82 on the key arms 86, 88 match the angles of the angled top portions 73, 74 of the asymmetric engagement member 70. Without this asymmetric matching the key 85 will not open the locking mechanism. The trunk 79 of the engagement member 70 fits into the asymmetric key 85 between the arms 86, 88 and restricts access to the tines 66, 68 by other objects which may be used to try to open the security device 40. As the key 85 pushes the right and left tine members 66, 68 away, the tip portions 83, 84 are adjacent parallel portions 75 of the right and left engagement member portions 76, 78 allowing the asymmetric engagement member to be withdrawn upward and the right and left tine members 66, 68 to spring back to their rest positions in the unlocked configuration.

The matching asymmetry of the key 85 and the asymmetric engagement member's 70 right and left tine members 66, 68 are a security feature as a symmetric key will not work with the asymmetric parts. The asymmetry also deters attempts to open the locking mechanism panel 37 by other implements.

The plateau 89 of the asymmetric key 85 tells the user which way the asymmetric key 85 fits in the engagement aperture pod 28 as seen in FIG. 2. The plateau 89 of the asymmetric key 85 will be aligned with the handle 22 on door portion 30 when the key is properly inserted in the engagement aperture pod 28 to operate the lock mechanism.

The handle 22 allows for easily swinging the door portion 30 to the open position for removing the engagement member pod 28 from the tine member pod 26. The front strap 36 can then be removed from the locking mechanism panel 37. The security package 40 is then available to be used on other items.

Alternatively the security package can be cut along one of the hinges 20 to release the item contained therein.

The U.S. Pat. No. 6,102,200 Security Package with Asymmetric Lock to Dressen et al. issued Aug. 15, 2000, Des. 343,356 Security Pakage to Witman issued Jan. 18, 1994, and U.S. Pat. No. 5,601,188 Security Package with Internal Pocket for a Surveillance Tag, to Dressen et al. issued Feb. 11, 1997 are all made a part hereof and incorporated herein by reference.

Locking mechanisms other than the asymmetric locking mechanism may be used. Symmetric locking mechanisms of the type described may be used. Locking mechanisms of other designs may also be used in conjunction with the strap 11 to lock the strap to the security device locking mechanism portion 20.

Obviously, many modifications and variations of the present invention are possible in light of the above teachings. It is therefore to be understood that, within the scope of the appended claims, the invention may be practiced otherwise than as specifically described.

What is claimed is:

1. An anti-theft security device comprising:

four walls, each wall having a hinge for hingedly connecting the four walls, and each wall having a top flange and a bottom flange, such that the four walls may be wrapped around and secure therein an item to be secured, a strap having a hinge for hingedly connecting the strap to a wall, the strap having at least one aperture therein, a locking mechanism portion attached to a wall, the locking mechanism portion having, a female tine member pod having tines therein, for alignment with the apertures on the strap portion, and a door portion hingedly attached to the locking mechanism portion, the door portion having a male engagement member pod for insertion through the aperture in the strap and insertion into the female tine member pod, thereby securing the strap to the locking mechanism portion by engaging the tines in the female tine member pod.

2. An anti-theft security device as in claim 1 further comprising:

an electronic article surveillance tag inside of the locking mechanism portion for setting off alarms.

3. An anti-theft security device as in claim 1 further comprising:

a key, the key having arms for engaging and pushing aside the tines to allow the male engagement member pod to disengage the tines thereby unlocking the locking mechanism.

4. An anti-theft security device as in claim 1 further wherein:

the tines are asymmetric tines the engagement member pod having a compatible asymmetric shape to match the asymmetric tines.

5. An anti-theft security device as in claim 1 further wherein:

the key is an asymmetric key compatible with the asymmetric tines and asymmetric engagement member pod such that non asymmetric keys with the proper dimensions will not be able to open the security device.

* * * * *